US007216699B2

(12) United States Patent
Nelson et al.

(10) Patent No.: US 7,216,699 B2
(45) Date of Patent: May 15, 2007

(54) SUB MUDLINE ABANDONMENT CONNECTOR

(75) Inventors: John Edward Nelson, Houston, TX (US); James A. Gariepy, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 271 days.

(21) Appl. No.: 10/737,565

(22) Filed: Dec. 16, 2003

(65) Prior Publication Data

US 2004/0163816 A1 Aug. 26, 2004

Related U.S. Application Data

(60) Provisional application No. 60/433,672, filed on Dec. 16, 2002.

(51) Int. Cl.
*E21B 19/18* (2006.01)

(52) U.S. Cl. ..... 166/77.51; 166/338; 166/340; 166/344; 166/350; 166/351; 166/368; 166/377

(58) Field of Classification Search ..... 166/77.51, 166/338, 340, 344, 345, 350, 351, 368, 377
See application file for complete search history.

(56) References Cited

U.S. PATENT DOCUMENTS 3,731,739 A * 5/1973 Herd ..... 166/365
4,185,856 A * 1/1980 McCaskill ..... 285/18
4,451,056 A 5/1984 Galle, Jr.
4,501,056 A 2/1985 Castel et al.
4,647,254 A * 3/1987 Baugh et al. ..... 405/169
4,848,472 A * 7/1989 Hopper ..... 166/344
5,002,129 A * 3/1991 Hopper ..... 166/338
5,222,560 A 6/1993 Brammer et al.
5,259,459 A * 11/1993 Valka ..... 166/345
5,299,642 A 4/1994 Nelson et al.
5,480,521 A 1/1996 Snyder, Jr. et al.
5,655,603 A * 8/1997 Schulte et al. ..... 166/368
5,755,533 A 5/1998 Snyder, Jr. et al.
5,868,204 A * 2/1999 Pritchett et al. ..... 166/368
6,035,938 A * 3/2000 Watkins ..... 166/345
6,142,233 A * 11/2000 Wilkins ..... 166/339

(Continued)

FOREIGN PATENT DOCUMENTS

GB 948323 1/1964

(Continued)

*Primary Examiner*—Thomas B. Will
*Assistant Examiner*—Christopher Buchanan
(74) *Attorney, Agent, or Firm*—Bracewell & Giuliani LLP

(57) ABSTRACT

An inner tubular member of a subsea wellhead assembly carries a locking member that moves between a locked and unlocked positions lands within an outer tubular member having a grooved profile in its bore. The inner tubular member joins to a portion of the conductor casing extending from a low pressure wellhead housing above the mudline of the seafloor. In the locked position, the locking member engages the grooved profile on the outer tubular member to connect the outer tubular member and inner tubular member. The inner tubular member also carries a hydraulically actuated, axially moveable locking sleeve that slidingly engages the locking member to move the locking member between the locked and unlocked positions. An ROV supplies hydraulic fluid through an ROV port to actuate the locking sleeve.

19 Claims, 8 Drawing Sheets

U.S. PATENT DOCUMENTS

| | | | | |
|---|---|---|---|---|
| 6,260,624 | B1 * | 7/2001 | Pallini et al. | 166/345 |
| 6,293,345 | B1 * | 9/2001 | Watkins | 166/368 |
| 6,978,839 | B2 * | 12/2005 | Fenton et al. | 166/348 |
| 2001/0045286 | A1 | 11/2001 | Pallini et al. | |
| 2002/0157834 | A1 * | 10/2002 | Gallagher et al. | 166/345 |
| 2005/0121198 | A1 * | 6/2005 | Andrews | 166/368 |

FOREIGN PATENT DOCUMENTS

| | | |
|---|---|---|
| GB | 2099883 A | 12/1982 |
| GB | 2335684 A | 9/1999 |
| GB | 2340572 A | 2/2000 |
| GB | 2362906 A | 1/2001 |

* cited by examiner

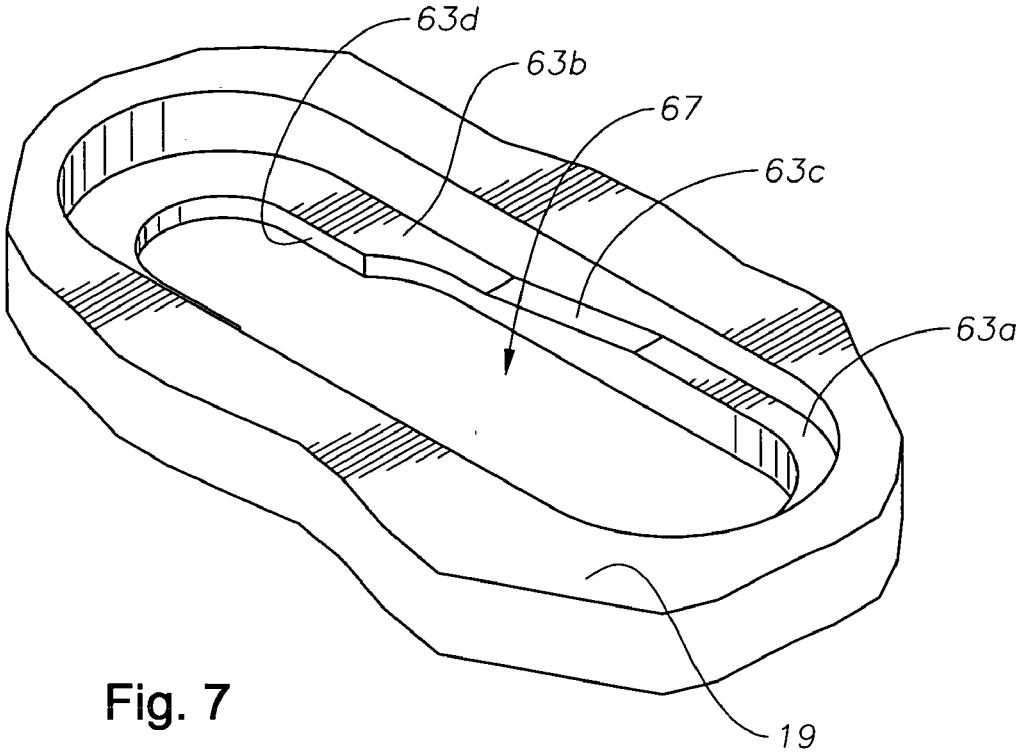
Fig. 7
Fig. 8
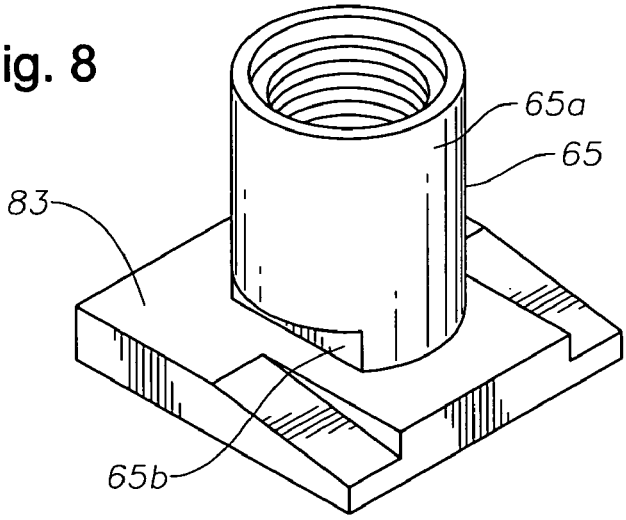

SUB MUDLINE ABANDONMENT CONNECTOR

RELATED APPLICATIONS

This patent application claims the benefit of co-pending, provisional patent application U.S. Ser. No. 60/433,672, filed on Dec. 16, 2002, which is hereby incorporated by reference in its entirety.

BACKGROUND OF THE INVENTION

1. Field of the Invention

The present invention relates generally to subsea wellhead assemblies, more specifically assemblies having a conuit with an upper portion capable of disconnecting from a lower portion that has been cemented into the well.

2. Background of the Prior Art

Subsea wells typically have a low pressure wellhead housing with a string of conductor casing suspended therefrom. A high pressure wellhead housing lands with in the low pressure wellhead housing and supports another string of casing suspended into the well. Additional intermediate hangers and strings of casing are supported within the high pressure wellhead housing which extend to deeper depths within the subsea well. In a typical subsea well, the outer casing suspended from the low pressure wellhead housing is embedded into the seafloor to a predetermined depth below the mudline.

When the well is abandoned after completing the exploratory drilling, many laws and regulations require that there cannot be any structure protruding above the seafloor. Several of the intermediate strings of casing are cut below the mudline to allow removal of the upper portion of those strings. The conductor casing suspended from the low pressure wellhead housing must also be cut to remove the low pressure wellhead housing. Cutting the conductor casing can be time consuming and does not allow for the conductor casing above the cut to be reused.

SUMMARY OF THE INVENTION

In this invention, a subsea wellhead assembly has an outer tubular member suspended below a low pressure wellhead housing. A grooved profile is formed in the bore of the outer tubular member. The outer tubular member receives an inner tubular member that is adapted to be joined to a sting of conductor casing extending upward to the low pressure wellhead housing. The inner tubular member carries a locking member that moves between a locked and unlocked position. In the locked position, the locking member engages the grooved profile on the outer tubular member. The inner tubular member is connected to the outer tubular member when the locking member engages the grooved profile.

The inner tubular member also carries an axially moveable locking sleeve. The locking sleeve is hydraulically actuated. The locking member slidingly engages the locking member for selectively camming the locking member between the locked and unlocked positions. A remote operated vehicle (ROV) port extends from the locking sleeve to the exterior of a portion of conductor casing joined to the inner tubular member. An ROV supplies hydraulic fluid through the ROV port to actuate the locking sleeve, and thereby the locking member. The ROV port can consist of a plurality of ports with some supplying hydraulic fluid below the locking sleeve to actuate the sleeve upward, and some for supplying hydraulic fluid above the locking sleeve to actuate the sleeve downward.

Typically, the outer tubular member has an upper end that is located below the mudline of the seafloor. Therefore, the ROV port extends through a portion of the casing joined to the inner tubular member, to an elevation above the seafloor terminating at a port for ROV or other means of hydraulic actuation. With the locking member in the unlocked position, and not engaging the grooved profile, the inner tubular member and portion of the conductor casing extending upwards therefrom can be lifted from within the outer tubular member located below the mudline.

BRIEF DESCRIPTION OF THE DRAWINGS

FIG. 7 is an enlarged perspective view of a portion of a locking sleeve of the connector housing shown in FIG. 1.

FIG. 8 is an enlarged perspective view of a portion of a dog of the connector housing shown in FIG. 1.

DETAILED DESCRIPTION OF THE PREFERRED EMBODIMENT

Figure 10:
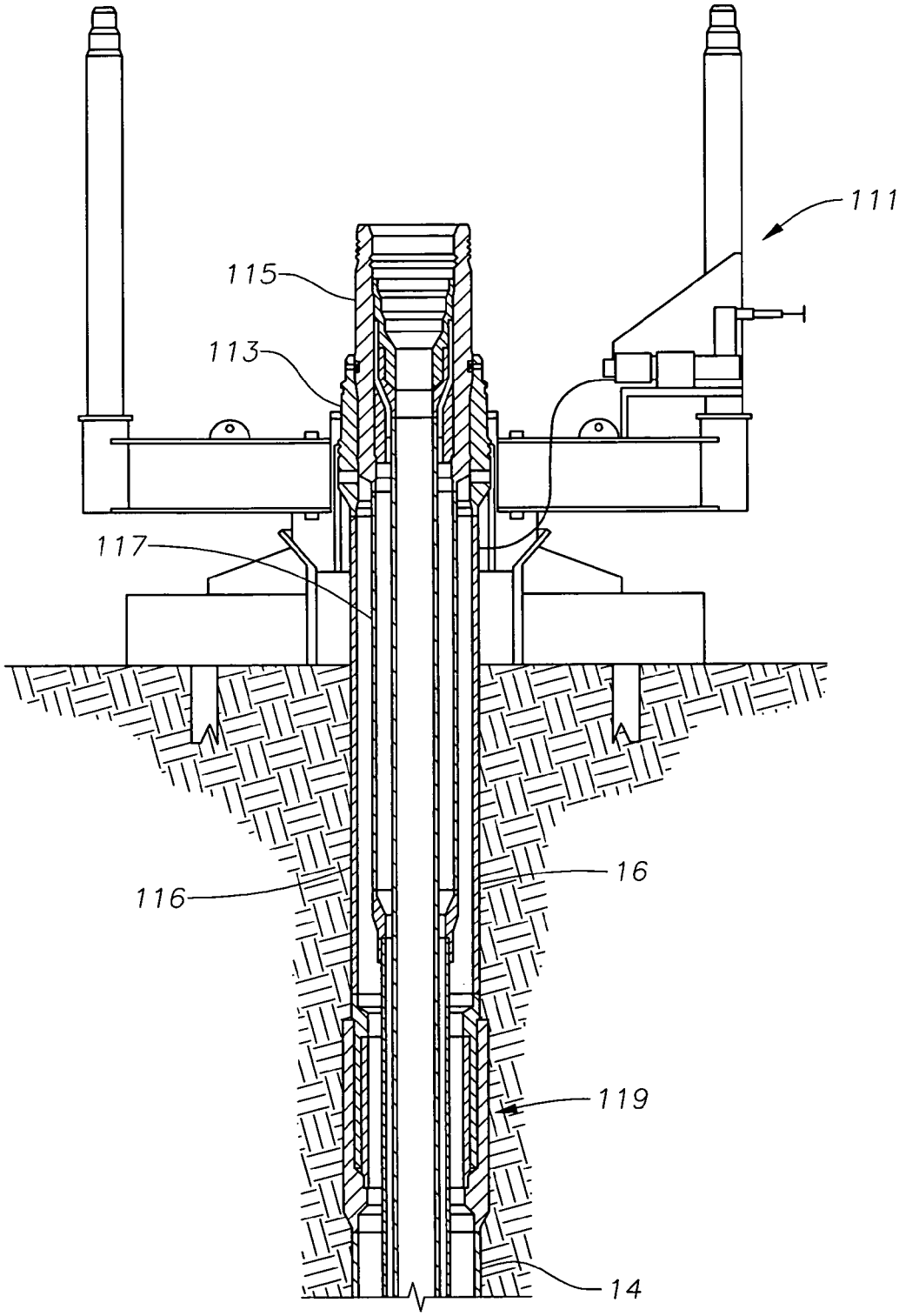
FIG. 10 is a sectional view of a subsea wellhead assembly with the submudline connector shown in FIG. 1 below the low pressure wellhead housing.

Referring to FIG. 10, a subsea wellhead assembly 111 is shown at the seafloor. A low pressure wellhead housing 113 is located above the mudline of the seafloor, with a string of conductor casing 116 extending from its lower end into the well. Low pressure wellhead housing 113 receives a high pressure wellhead housing 115, which has a string of intermediate casing 117 extending from its lower end into the well. A sub mudline abandonment connector, or connector 119 is shown as part of conductor casing 116 below low pressure wellhead housing 113. String of casing 117 extends through the inner bore of connector 119. Conductor casing 116 includes an upper conductor casing 16 extending between the upper end of connector 119 and lower pressure wellhead housing 113. Conductor casing 116 also includes a lower conductor casing extending from the lower end of connector 119 further into the well.

Figure 1:
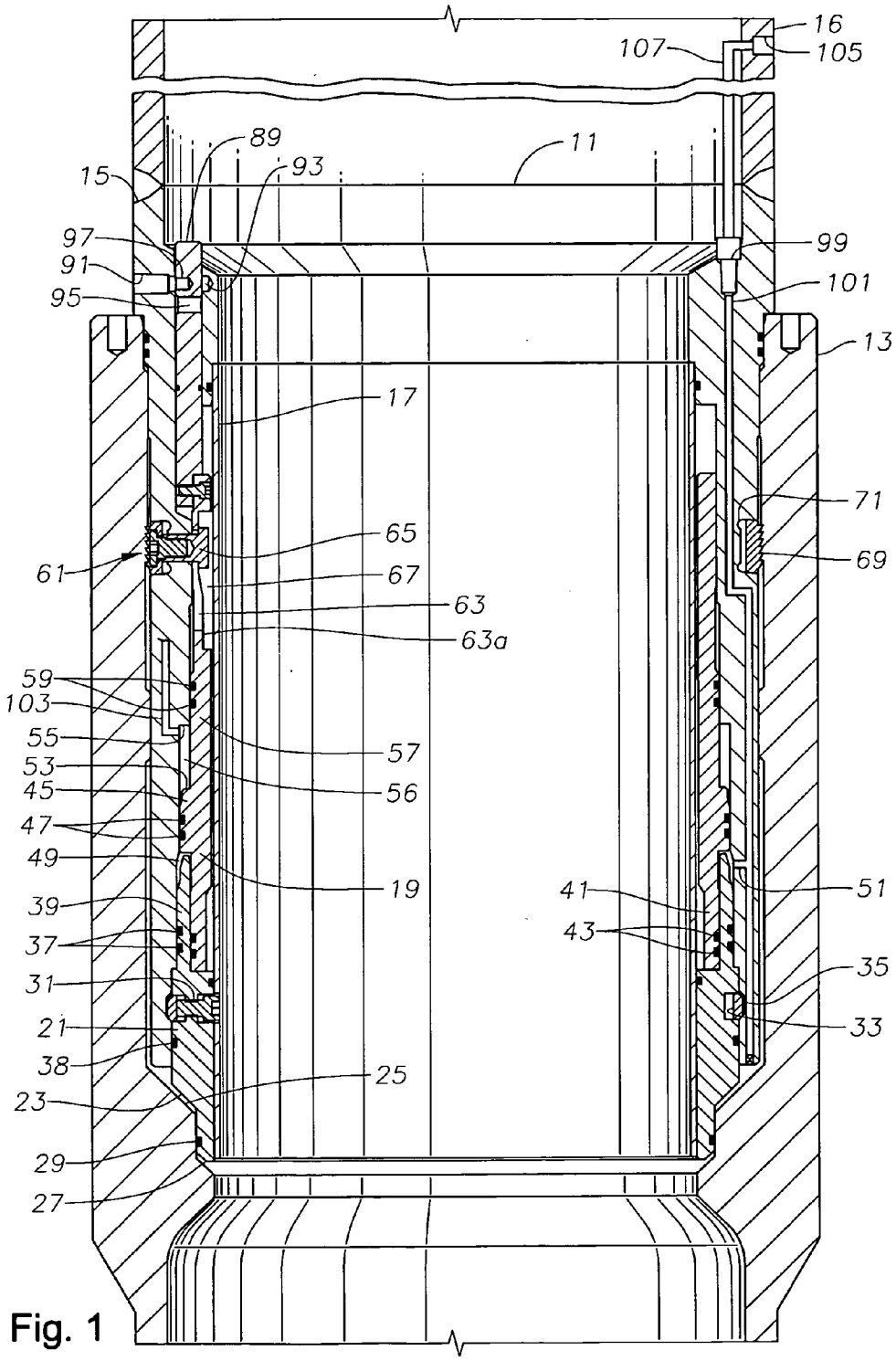
FIG. 1 is a cross-sectional view of a sub mudline abandonment connector in a outer tubular member of a subsea wellhead assembly constructed in accordance with this invention, with the connector in its locked position.

Referring to FIG. 1, subsea mudline abandonment connector, or connector 119 is shown positioned with an outer tubular member 13 enclosing connector 119. Outer tubular member 13 has a string of conductor casing 14 extending from the lower portion. Outer tubular member 13 is typically located below the mudline of the sea floor, after it has been cemented into place in a manner known in the art. Connector 119 preferably includes an inner tubular member 11 that is typically designed to interface with outer tubular members 13 having either 30-inch or 36-inch diameter string of conductor casing extend into the well. Inner tubular member 11 lands and sealingly engages the bore of outer tubular member 13. Inner tubular member 11 preferably has an inner tubular member or connector casing 15 that is joined to a lower end of a upper conductor casing 16 extending to low pressure wellhead housing 113.

Inner tubular member 11 also preferably has an inner sleeve 17 that comprises the bore of inner tubular member 11. A locking sleeve 19 is located between connector casing 15 and inner sleeve 17. A landing sleeve 21 is preferably located with a portion below locking sleeve 19 and between connector casing 15 and inner sleeve 17. Landing sleeve 21 has an inclined surface 23 extending below connector casing 15 that lands on an upwardly facing shoulder 25 of outer tubular member 13. Landing sleeve 21 has an inner leg 27 located below and radially inward of inclined surface 23. Inner leg 27 extends axially below shoulder 25 when inclined surface 23 lands on shoulder 25. A seal 29, located around the outer surface of inner leg 27, sealingly engages an inner surface of outer tubular member 13 below shoulder 25.

A threaded fastener preferably a screw 31 extends through landing sleeve 27 and engages connector casing 15 and inner sleeve 17 to prevent movement of landing sleeve 27 relative to connector casing 15 and inner sleeve 17. Screw 31 is located axially below locking sleeve 19. In the preferred embodiment, screw 31 engages a ring 33 that matingly fits into a groove 35 located on the inner surface of connector casing 15. In the preferred embodiment, ring 33 is a C-Ring that is biased radially inward. The screw 31 expands ring 33 outward to lock ring 33 in groove 35. Preferably, landing sleeve 27 can be removed from between connector casing 15 and inner sleeve 17 when a predetermined force is applied.

A plurality of landing sleeve seals 37, 38 are preferably located above and below screw 31 and engage the inner surface of connector casing 15. An upper tubular member 39 defines an upper portion of landing sleeve 27. Landing sleeve seals 37, which are above screw 31, are preferably located on the outer surface of upper tubular member 39. Upper tubular member 39 has a larger inner diameter than the remaining portion of landing sleeve 27, and does not engage inner sleeve 17.

Locking sleeve 19 has a lower tubular member 41 located towards the lower portion of locking sleeve 19. Lower tubular member 41 has an outer diameter that is less than the inner diameter of upper tubular member 39 on landing sleeve 27. The outer surface of lower tubular member 41 slidingly engages the inner surface of upper tubular member 39. At least one seal 43, preferably a pair of seal rings extending around the outer circumference of lower tubular member 41, engages the inner surface of upper tubular member 39 on landing sleeve 27.

A piston 45 is formed on the outer surface of locking sleeve 19. Piston 45 protrudes radially outward from a portion of locking sleeve 19 and slidingly engages the inner surface of connector casing 15. At least one piston seal 47 extends around the outer circumference of piston 45 to sealingly engage the inner surface of connector casing. Piston 45 is preferably located axially above upper tubular member 39. A lower annular chamber 49 is defined between piston 45, upper tubular member 39, and the outer surface of lower tubular member 41 of locking sleeve 19. Annular clamber 49 receives a hydraulic fluid to actuate locking sleeve 19 from a locked position shown in FIG. 1 to a latched but unlocked position shown in FIG. 5, and then to an unlocked and unlatched position shown in FIG. 2. Seals 37, 43, 47 help to prevent the hydraulic fluid from escaping lower annular chamber 49 when hydraulic fluid is injected into lower annular chamber 49. A hydraulic port 51 formed in the inner surface of connector casing 15 at substantially the same axial position as the upper portion of upper tubular member 39, communicates the hydraulic fluid into lower annular chamber 49 to actuate locking sleeve 19. Annular chamber 49 increases in sizes as piston 45 moves from the locked position shown in FIG. 1 to the unlocked and unlatched position shown in FIG. 2.

Figure 2:
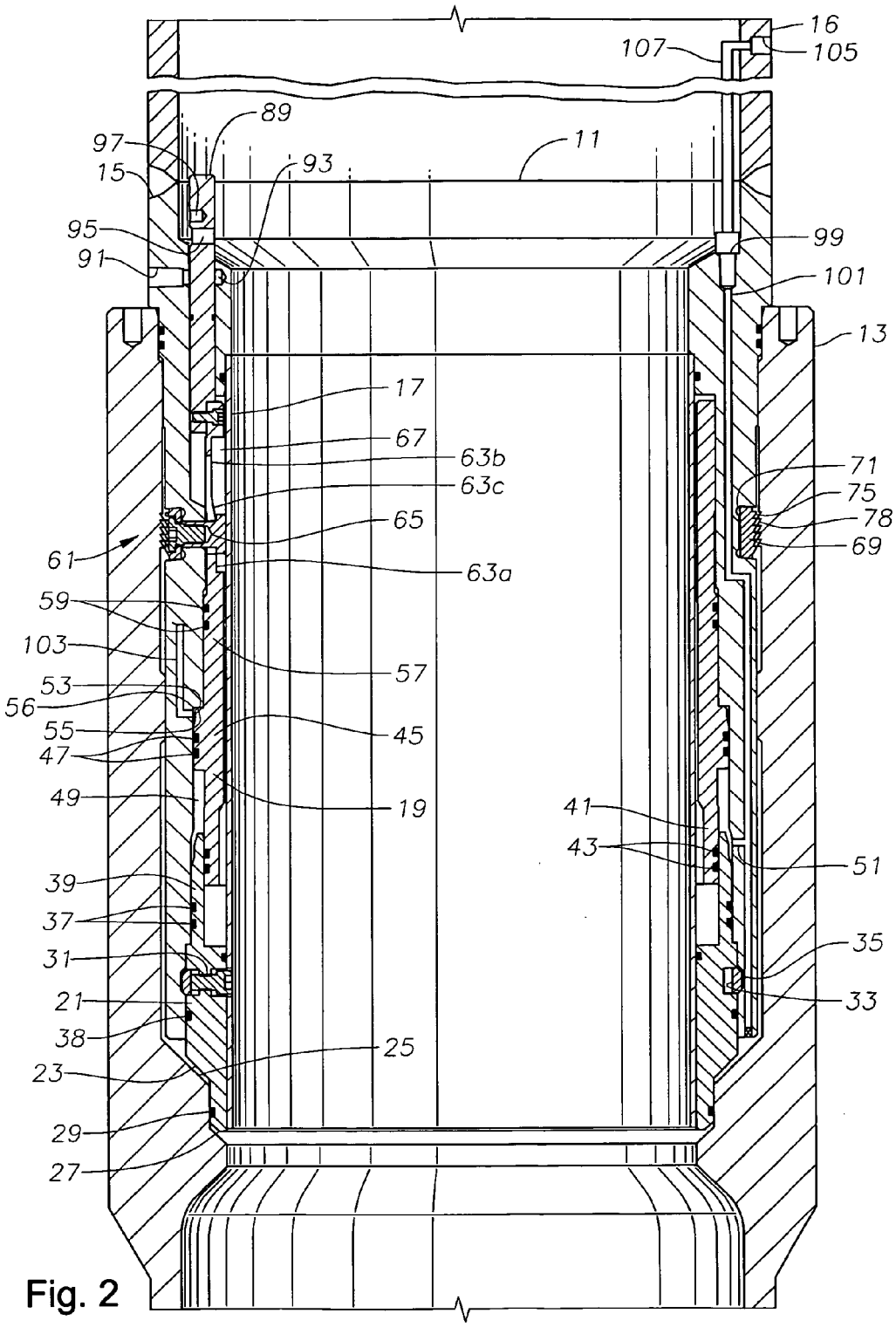
FIG. 2 is a cross-sectional view of the connector and outer tubular member shown in FIG. 1 in its unlocked and unlatched position.

A piston shoulder 53 is formed toward the upper portion of piston 45. A downward facing lip 55 formed on the inner surface of connector casing 15 prevents piston 45 from sliding axially upward along connector casing 15 after piston shoulder 53 engages lip 55. The portion of connector casing axially below lip 55 has a larger inner diameter than the portion of connector casing above lip 55. An upper annular chamber 56 is defined between piston shoulder 53 and lip 55. As shown in FIG. 2, locking sleeve 19 is in its unlocked and unlatched position when piston shoulder 53 engages lip 55, thereby preventing further upward motion of locking sleeve 19. A medial portion 57 of locking sleeve 19 located above piston 45 slidingly engages the inner surface of the portion of connector casing 15 located above lip 55. At least one seal 59, preferably a pair of seal rings extending around the outer surface of the medial portion 57 of locking member 19, sealing engages the inner surface of the portion of connector casing 15 located above lip 55.

Figure 4:
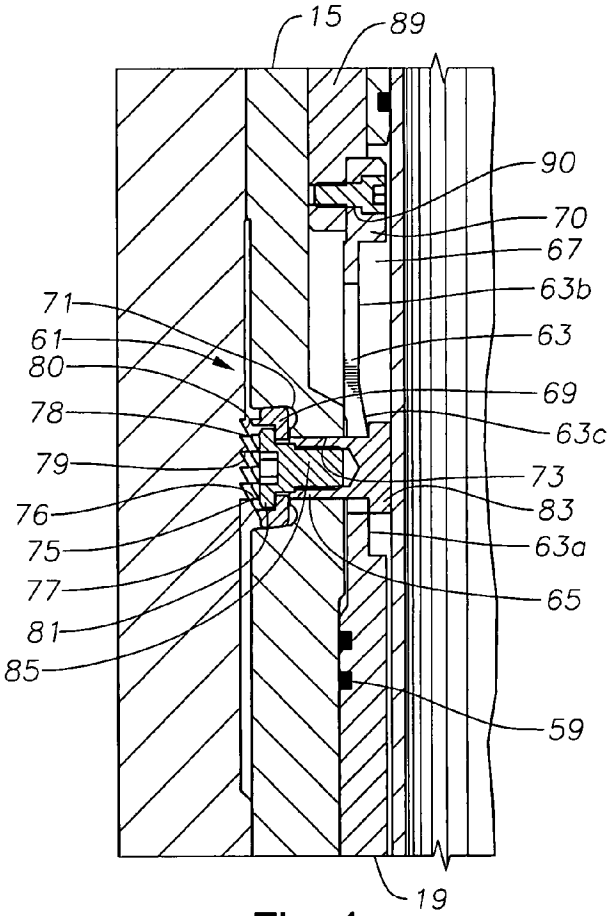
FIG. 4 is an enlarged cross-sectional view of one side of the connector and outer tubular member shown in FIG. 2 in its unlocked and unlatched position.
Figure 3:
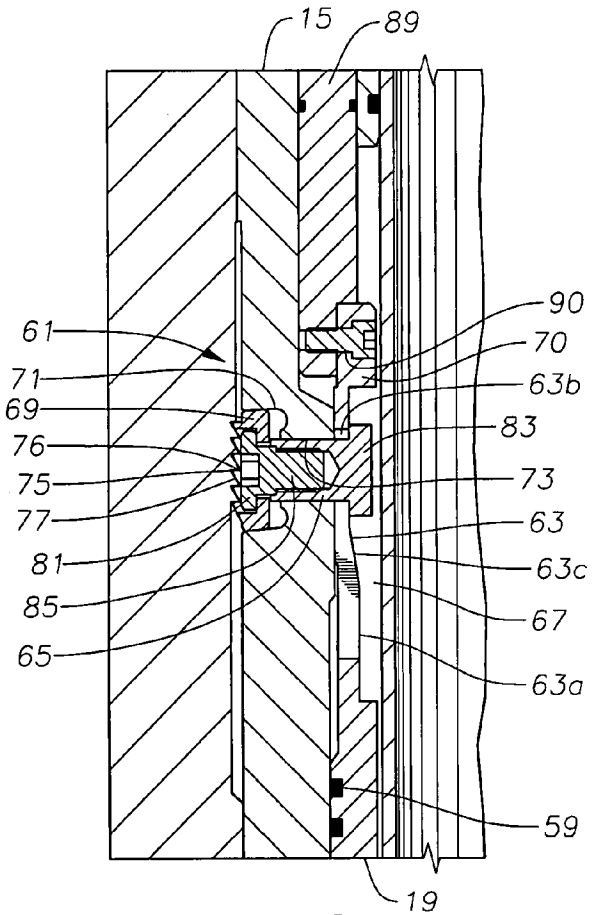
FIG. 3 is an enlarged cross-sectional view of a portion of the one side of the connector and outer tubular member shown in FIG. 1 in its locked position.

Referring to FIGS. 3 and 4, at least one lock 61 is located above medial portion 57 of locking sleeve 19. Lock 61 comprises a lock cam 63, a locking dog 65 and a locking slot 67, and a lock ring 69. Lock cam 63 is formed above medial portion 57 with a lower portion 63*a* of lock cam 63 connected to medial portion 57 of locking sleeve 19. Lock cam 63 has substantially the same outer circumference as medial portion 57 of locking sleeve 19. As shown in FIG. 7, locking cam 63 is formed adjacent a portion of locking slot 67. In the preferred embodiment, locking slot 67 passes through locking sleeve 19, locking cam 63 is formed along the sides of locking slot 67. Lock cam 63 preferably also comprises an upper portion 63*b* and an inclined or middle portion 63*c*. Lock cam upper portion 63*b* connects to an upper portion 70 of locking sleeve 19, which extends axially upward from lock cam 63. Lock cam upper portion 63*b* has a larger inner diameter than lock cam lower portion 63*a*, so that upper portion 63*b* is thinner than lower portion 63*a*. Lock cam inclined portion 63*b* is inclined along the inner surface to connect the radially inward inner surface of lower portion 63*a* with the radially outward inner surface of upper portion 63*b*.

A lock ring recess 71 is formed on the outer surface of connector casing 15 axially above medial portion 57 of locking sleeve 19. Lock ring 69 extends around the circumference of connector casing 15 and rests in lock ring recess 71. In the preferred embodiment, lock ring 69 is a C-Ring that is biased radially outward. Lock ring recess 71 engages the upper and lower ends of lock ring 69, thereby holding lock ring 69 axially relative to connector casing 15. In the preferred embodiment, a plurality teeth 75 extend circumferentially around the outer circumference of lock ring 71. Each tooth 75 has an axially upward facing lip 76 and an angled leading edge 77 located below each lip 76. A plurality of grooves 78 are formed on the inner surface of outer tubular member 13. Grooves 78 are preferably formed around the inner circumference of outer tubular member 13 so that when inclined surface 23 of landing sleeve 21 engages shoulder 25 of outer tubular member, grooves 78 are at substantially the same axial elevation as teeth 75. Each groove 78 has an axially downward facing lip 79 and an angled trailing edge 80 located above each lip 79. Leading edges 77 of teeth 75 slide along trailing edges 80 of grooves 78 and allow lock ring 69 to travel axially downward relative to grooves 78 and outer tubular member 13. Lock ring 69 and connector casing 15 cannot move axially upward relative to outer tubular member 13 when upward facing lips 76 engage downward facing lips 79.

A passage 73 is formed in connector casing 15 and extends between lock ring recess 71 and lock cam 63. Preferably, locking dog 65 is located within passage 73. Locking dog 65 has an outer end 81 that engages lock ring 69, and a dog head or inner end 83 that engages lock cam 63. Lock ring 69 is preferably biased radially outward for teeth 75 to engage grooves 78. Locking dog 65 preferably has a threaded fastener or screw 85 located between its inner and outer ends 83, 81 so that locking dog 65 supplies a radially inward force against lock ring 69. As shown in FIG. 8, the dog head 83 has inclined surfaces that matingly engage lock cam 63 as dog 65 is actuated along the surfaces of cam portions 63*a*, 63*b*, 63*c*. FIG. 8 also shows a barrel 65*a*, which is the portion of dog 65 that extends above dog head 83. Barrel 65*a* also passes through locking slot 67 and passageway 73 in connector housing 15. A flat 65*b* is located toward the interface of barrel 65*a* and dog head 83. In the preferred embodiment, there are a pair of flats 65*b* on opposite portions of barrel 65*a* where barrel 65*a* connects to dog head 83. Referring to FIG. 7, a slot 67 includes a reduced area portion, or reduced area slot 63*d* located adjacent upper cam portion 63*b*. Slot 67 has a large enough area for barrel 65*a* to pass through slot 67 as dog head 83 actuates along cam portions 63*a* and 63*c*. The area of slot 67 is smaller that the area of barrel 65*a* in reduced area slot 63*d*. The portion of cam 63 in reduced area slot 63*d* engages flats 65*b* as dog head 83 actuates from cam portion 63*c* to 63*b*. Reduced area slot acts as a physical barrier to prevent ring 69 and dog 65 from moving radially inward relative to slot 67 when reduced slot area 63*d* engages flats 65, thereby locking lock 61.

Figure 6:
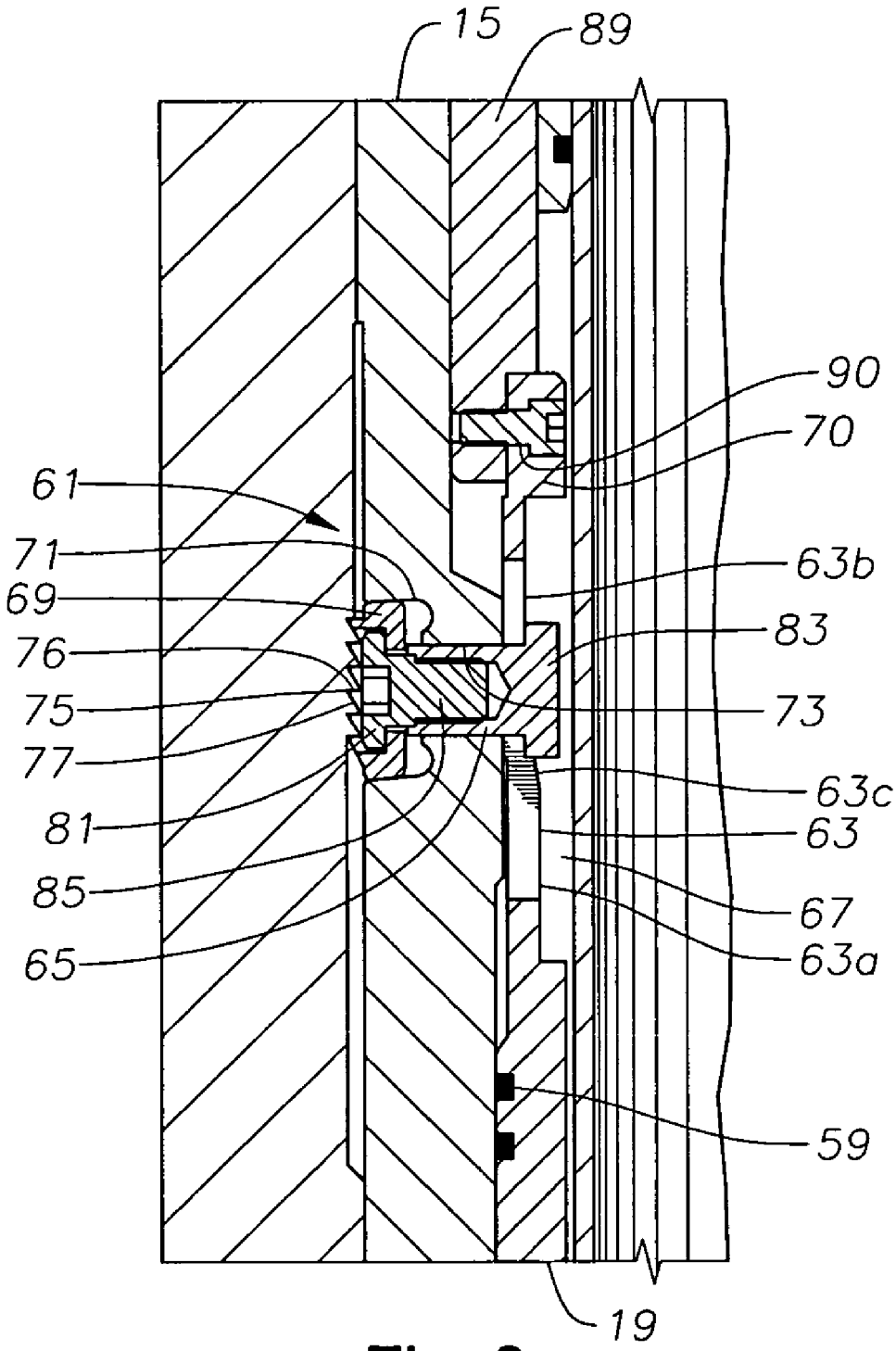
FIG. 6 is an enlarged cross-sectional view of a portion of the one side of the connector and outer tubular member shown in FIG. 5 in its latched but unlocked position.

In the preferred embodiment, lock dog 65 extends through locking slot 67 so that inner end or head of dog 65 is radially inward of lock cam 63. The head of dog 65 slidingly engages the inner surface of lock cam 63. Dog 65 is forced radially inward as it slides from lock cam upper portion 63*b* to lock cam lower portion 63*a*. Dog 65 pulls its outer end 81 radially inward, which in turn pulls the lock ring 69 radially inward. Dog 65 is moved radially inward as cam lock 63 is actuated by piston 45 between its locked position shown in FIG. 3, its latched but unlocked position shown in FIG. 6, and its unlocked and unlatched position shown in FIG. 4. As shown in FIG. 4, in the unlocked and unlatched position, dog 65 pulls its outer end 81 radially inward enough so that teeth 75 do not engage grooves 78, thereby allowing connector casing 15 to move axially upward relative to outer tubular member 13.

Figure 5:
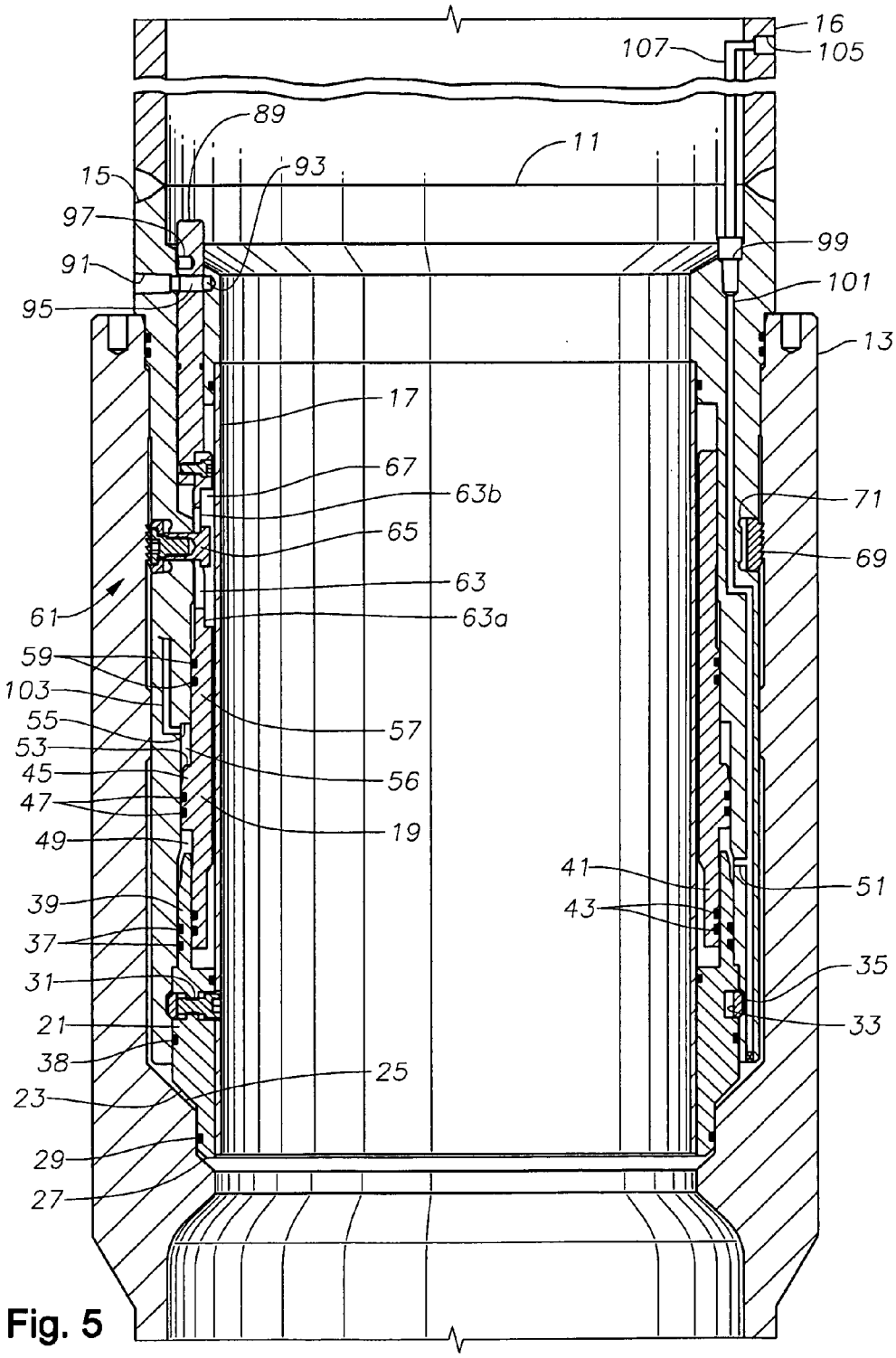
FIG. 5 is a cross-sectional view of the connector and outer tubular member shown in FIG. 1 in its latched but unlocked position.

Locking sleeve 19 also includes an upper member, or sleeve location indicator 89 that connects to upper portion 70. A threaded fastener 90, preferably a screw, connects a lower portion of location indicator 89 to upper portion 70. Location indicator 89 extends axially upward from upper portion 70 to an axial elevation above outer tubular member 13. Referring to FIGS. 1, 2, and 5, an indicator passageway 91 extends through connector casing 15 from its outer surface to its inner surface. Indicator passageway 91 is located toward the upper portion of connector casing 15 so that indicator passageway 91 is above the top of outer tubular member 13 when inclined surface 23 of landing sleeve 21 engages shoulder 25 of outer tubular member. Indicator passageway 91 aligns with an inner opening 93 formed in an radially inward portion of conductor casing 15.

An additional indicator passageway 95 extends through location indicator 89 of locking sleeve 19. An intermediate opening 97 is also formed above indicator passageway 95 in the outer surface of location indicator 89 of locking sleeve 19. Indicator passages 91, 95 and openings 93, 97 are typically only useful to an operator when working on the connector 119 at the surface. Indicator passages 91, 95 and openings 93, 97 can help an operator determine the position of the lock 61 by monitoring the location of locking sleeve 19. As shown in FIG. 1 for example, opening 97 of locking sleeve 19 aligns with indicator passage 91 when connector 119 is in its locked position. An indicator or gage tool (not shown), when inserted into passage 91 and opening 97, only inserts to a first predetermined length that shows the operator that connector 119 is in its locked position.

As shown in FIG. 2, passage 91 opens to the outer surface of location indicator 89 of locking sleeve 19. A gage tool (not shown) only inserts to a second predetermined length that shows that connector 119 is in its unlocked and unlatched position. The second predetermined length is shorter in length than the first predetermined length. As shown in FIG. 5, passage 91 opens into passage 95 in location indicator 89 of locking sleeve 19, which opens into opening 93 of the radially inward portion of outer tubular member 15. The indicator (not shown) inserts to a third predetermined length showing that connector 119 is in a latched but unlocked position. Typically, connector 119 is only in the latched but unlocked position shown in FIGS. 5 and 6 while connector casing is at the surface and being worked on. Additionally, in the preferred embodiment, connector 119 is already locked in outer tubular member 13 when outer tubular member 13 is landed at the sea floor. The latched but unlocked position allows the operator to stab or ratchet lock ring 69 to secure inner tubular member 11 axially relative to outer tubular member 13 without the use of hydraulics while at the surface. A pipe plug (not shown) is inserted into indicator passage 91 before connector casing is installed at the sea floor to prevent mud from entering passage 91.

When connector 119 is below the seafloor, hydraulic fluid is used to lock and unlock inner tubular member 11 to outer tubular member 13. A stab or hydraulic port opening 99 is located toward the upper end of connector casing 15. A hydraulic passageway 101 connects port opening 99 in fluid communication with hydraulic port 51. Hydraulic passageway 101 supplies hydraulic fluid to lower annular chamber 49 to actuate piston 45, moving piston 45 upward, causing lock cam 63 to pull locking dog 65 and teeth 75 away from grooves 78, therefore unlocking lock 61. Another hydraulic passage 103 provides communication from a port (not shown) located at the upper portion of connector casing 15 with upper annular chamber 56. Any fluid in upper chamber 56 vents out hydraulic passage 103 when piston 45 moves upward due to hydraulic fluid injected into lower annular chamber 49. Any fluid in lower annular chamber 49 vents out hydraulic passage 101 when hydraulic fluid is injected through hydraulic passage 103 into upper annular chamber 56 and pushes piston 45 downward.

In the preferred embodiment, a port opening 105 extends through a side of upper conductor casing 16 at an elevation above the mudline of the seafloor. A string of tubing 107 extends from port opening 105 through a lower portion of upper conductor casing 16 and stabs into hydraulic port opening 99. Preferably, tubing 107 stabs into port opening 99 when connector casing 15 attaches to upper conductor casing 16. The combination of port opening 105, tubing 107, port opening 99, and either hydraulic passage 101 or 103 define an ROV port for either raising or lowering locking sleeve 19. In the preferred embodiment, there are a plurality of port openings 105, tubing 107, and port openings, so that when combined with the other hydraulic passage 101, 103 another ROV port is defined for either raising or lowering locking sleeve 19.

Figure 9:
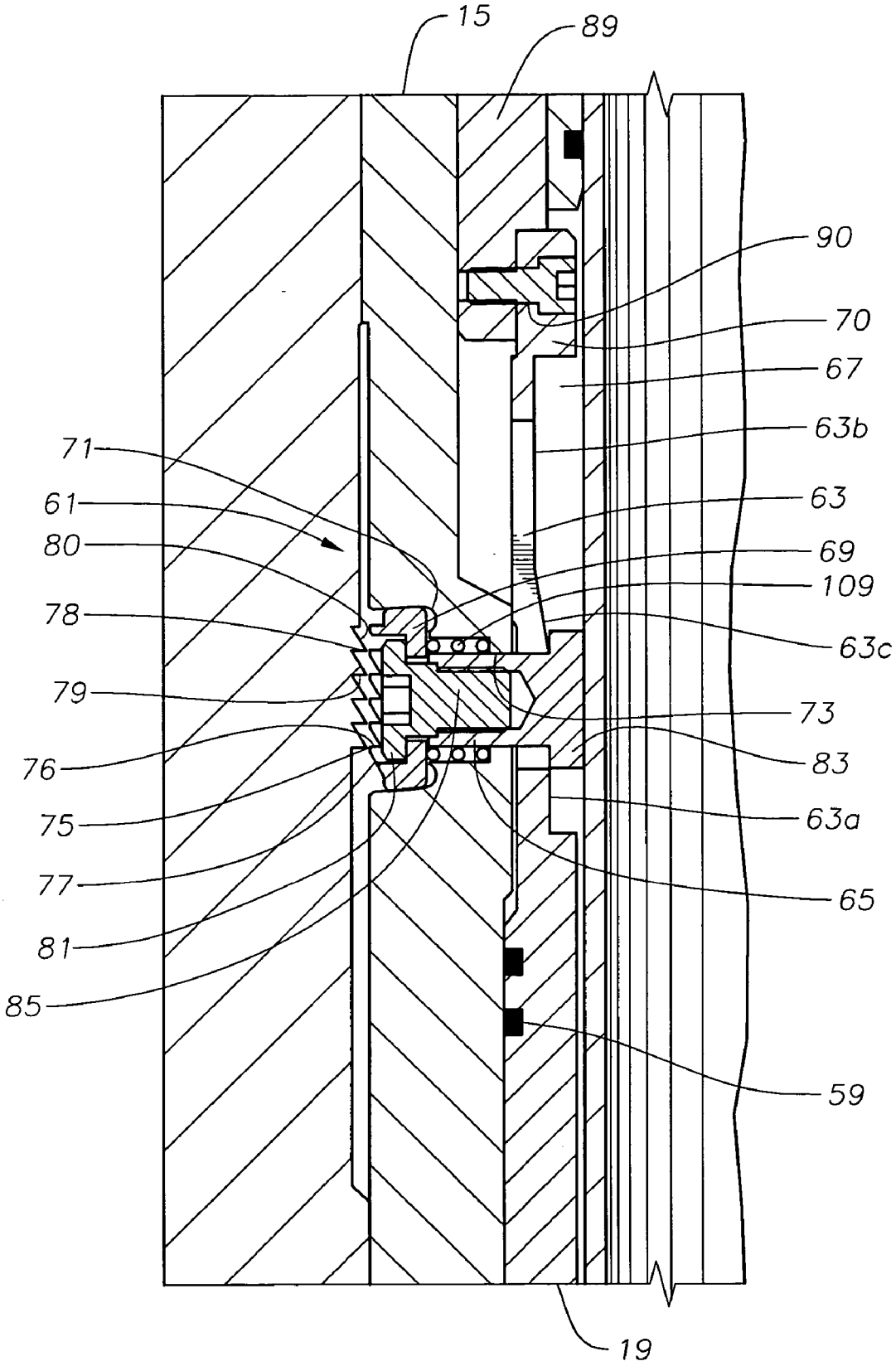
FIG. 9 is an enlarged cross-sectional of an alternative embodiment of the portion of connector and outer tubular member shown in FIGS. 3, 4, and 6 in its locked position.

Referring to FIG. 9, a spring 109 biases lock dog 65 radially outward. Spring 109 helps prevent slippage of lock dogs 65 out of alignment when upper conductor casing 16 and connector 119 are stored at the surface before being lowered to the subsea well. In some situations, horizontal storage causes lock dogs 65 and locking sleeve 19 to slide relative to each other, which misaligns teeth 75 of lock ring 71, which can later damage teeth 75 when lock ring 71 is actuated outward. Spring 109 helps reduce slippage of locking sleeve 19 and lock dogs 65 during horizontal storage.

In operation, inner tubular member 11 is already landed or installed inside outer tubular member 13 at the surface before outer tubular member 13 is lowered to beneath the seafloor. Outer tubular member 13, with inner tubular member 11 inside, is landed and cemented into place. In the preferred embodiment, piston 45 is in its lower position and lock 61 is therefore in its locked position when outer tubular member 13 is landed and the well is producing well fluids. Inner tubular member 11 and outer tubular member 13 are typically below the mudline. Nothing can protrude above the mudline when the subsea well is abandoned. When the well is to be shut down, inner outer tubular member 11, upper casing 16, and low pressure wellhead housing 113 can be removed instead of cutting the portion of conductor casing 116 below the mudline.

An ROV stabs into port opening 105 to supply hydraulic fluid into tubing 107. Alternatively, port opening 105 can also be in fluid communication with a common ROV port, or control module at which an ROV actuates a series of valves for the entire subsea wellhead assembly. At the common module or stab port, the ROV either directly injects or opens valves and causes hydraulic fluid into tubing 107. Hydraulic fluid is injected through tubing 107 and hydraulic port opening 99 into passageway 101. The hydraulic fluid communicates through passageway 101 to hydraulic port 51, where the hydraulic fluid enters lower annular chamber 49. As more hydraulic fluid enters annular chamber 49, the pressure increases and causes piston 45 to slide axially upward from the locked position shown in FIG. 1 to the unlocked position shown in FIG. 2. Lock cam 63 moves upward relative to connector casing 15 as piston 45 moves from its position shown in FIG. 1 to the position shown in FIG. 2. Lock cam 63 slides through locking dog 65 so that dog head 77 slides from lock cam upper portion 63*b*, over inclined portion 63*c*, to lock cam lower portion 63*a*, thereby pulling teeth 75 out of engagement with grooves 78. As shown in FIGS. 2 and 4, the operator can lift inner tubular member 11 out of outer tubular member 13 since teeth 75 do not engage grooves 78 in the unlocked position. In order to remove inner tubular member 11 from outer tubular member 13, a predetermined upward force must be applied for ring 33 to slide out of recess 35. After inner tubular member 11 has been removed from outer tubular member 13, the operator can complete the abandonment of the well in a manner known in the art, without having to cut any portion of the wellhead.

While the invention has been shown in only some of its forms, it should be apparent to those skilled in the art that it is not so limited, but is susceptible to various changes without departing from the scope of the invention. For example, rather than positioning the piston 45 below lock 61, a piston could be placed above the lock cam and locking dogs which would reduce the length of each of the hydraulic passages leading to the upper and lower annular chambers.

While the invention has been shown in only some of its forms, it should be apparent to those skilled in the art that it is not so limited but is susceptible to various changes without departing from the scope of the invention.

That claimed is:

1. A subsea wellhead assembly, comprising:

a lower section of outer casing extending into a well to a selected depth, the lower section of outer casing having an upper end located within the well below a sea floor;

an outer tubular member secured to the upper end of the lower section of outer casing and having a bore containing a grooved profile;

an inner tubular member that lands within the outer tubular member;

an upper section of outer casing located in the well and having a lower end secured to the inner tubular member;

a subsea wellhead housing secured to an upper end of the upper section of outer casing and protruding above the sea floor;

a locking member carried by the inner tubular member that moves between a locked and unlocked position relative to the grooved profile to lock the inner tubular member to the outer tubular member;

an axially moveable, hydraulically actuated locking sleeve carried within the inner tubular member that slidingly engages the locking member for selectively camming the locking member between the locked and unlocked positions; and a hydraulic fluid passage extending from the locking sleeve to supply hydraulic fluid to move the locking member to the unlocked position, allowing the wellhead housing, the upper section of outer casing and the inner tubular member to be withdrawn from the well in the event of abandonment of the well.

2. The subsea wellhead assembly according to claim 1, wherein the locking member comprises a resilient split ring extending around the outer circumference of the inner tubular member, the split ring being outwardly biased into engagement with the grooved profile.

3. The subsea wellhead assembly according to claim 2, wherein the locking member further comprises:

a pin member extending radially through an aperture in the inner tubular member and connected to the split ring;

a cam surface on the locking sleeve for pulling the pin member radially inward, which in turn pulls the split ring radially inward from the grooved profile when the locking sleeve is stroked axially in one direction.

4. The subsea wellhead assembly according to claim 1, wherein the locking member comprises a pin member that extends radially from an outer portion of the locking member through an aperture in the inner tubular member into engagement with the locking sleeve.

5. The subsea wellhead assembly according to claim 4, wherein the pin member is biased radially outward.

6. The subsea wellhead assembly according to claim 1, wherein the hydraulic fluid passage further comprises tubing extending alongside the upper section of outer casing upward within the well to an ROV port above the sea floor.

7. The subsea wellhead assembly according to claim 1, wherein the locking member actuates between locked and unlocked positions by moving radially inward and outward.

8. The subsea wellhead assembly according to claim 1, wherein the locking sleeve further comprises a piston formed on an outer surface of the locking sleeve; and a fluid chamber defined by the piston for receiving the hydraulic fluid to force the piston and locking sleeve axially upward and downward.

9. The subsea wellhead assembly according to claim 8, wherein the hydraulic fluid passage further comprises at least two hydraulic fluid ports, one of which capable of transmitting the hydraulic fluid into a portion of the chamber axially below the piston, and the other port being capable of transmitting hydraulic fluid into a portion of the chamber axially above the piston.

10. A subsea wellhead assembly, comprising:

an outer tubular member in a subsea well with an upper end below the seafloor and having a bore containing a grooved profile;

a lower section of outer casing connected to a lower end of the outer tubular member and extending into the well to a selected depth;

an inner tubular member that inserts into the outer tubular member;

an upper section of outer casing connected to an upper end of the inner tubular member and extending upward in the well;

a subsea wellhead housing protruding above the sea floor and secured to an upper end of the upper section of outer casing;

a locking member carried by the inner tubular member that moves between a locked and unlocked position relative to the grooved profile to lock the inner tubular member to the outer tubular member;

an axially moveable, hydraulically actuated locking sleeve carried within the inner tubular member that slidingly engages the locking member for selectively camming the locking member between the locked and unlocked positions;

a hydraulic passage extending from the locking sleeve through a portion of the inner tubular member; and an ROV line extending within the well from the hydraulic passage to a position above the seafloor for interfacing with an ROV to supply hydraulic fluid to move the locking sleeve to the unlocked position, enabling the wellhead housing, the upper section of outer casing and the inner tubular member to be removed from the well.

11. The subsea wellhead assembly according to claim 10, wherein the locking member comprises a resilient, outward-biased split ring extending around the outer circumference of the inner tubular member.

12. The subsea wellhead assembly according to claim 10, wherein the locking member further comprises a pin member that extends from the split ring through an aperture in the inner tubular member into engagement with the locking sleeve; and wherein movement of the split ring in one axial direction pulls the pin member radially inward, which in turn pulls the split ring inward to the unlocked position.

13. The subsea wellhead assembly according to claim 3, wherein the pin member and the locking sleeve have cooperating cam surfaces.

14. The subsea wellhead assembly according to claim 10, wherein the locking sleeve actuates the locking member to a latched but unlocked position by axially sliding to a substantially middle position of an axial stroke of the locking sleeve.

15. The subsea wellhead assembly according to claim 10, wherein the locking member actuates between locked and unlocked positions by moving radially inward and outward.

16. The subsea wellhead assembly according to claim 10, wherein the locking sleeve further comprises a piston formed on an outer surface of the locking sleeve; and a fluid chamber defined by the piston for receiving a hydraulic fluid to force the piston and locking sleeve axially upward and downward.

17. The subsea wellhead assembly according to claim 16, wherein the ROV passage further comprising at least two hydraulic fluid passages, one of which is capable of transmitting hydraulic fluid into a portion of the chamber axially below the piston, and the other port being capable of transmitting hydraulic fluid into a portion of the chamber axially above the piston.

18. A method of removing a subsea wellhead housing from a subsea well, the wellhead housing being secured to outer casing extending into the well to a selected depth, the method comprising:

(a) prior to installing the outer casing, providing the outer casing with a releasable joint a selected distance below the wellhead housing, the releasable joint comprising:

an inner tubular member connected to the lower end of a portion of outer casing extending into the well from the wellhead housing;

an outer tubular member on an upper end of a lower section of the outer casing and having a grooved profile on its interior surface, the inner tubular member being located within the outer tubular member;

a locking member that selectively engages the grooved profile and is carried by the inner tubular member; and a locking sleeve that slidingly engages the locking member for actuating the locking member between locked and unlocked positions;

(b) when abandonment of the well is desired, injecting hydraulic fluid to slide the locking sleeve relative to the locking member, thereby moving actuating the locking member out of engagement with the grooved profile; then (c) pulling the wellhead housing straight upward without rotation, bringing along with it the upper section of the outer casing and the inner tubular member.

19. The method according to claim 18, wherein step (b) comprises injecting the hydraulic fluid from an ROV.

* * * * *